US009290884B2

(12) United States Patent
Stingl et al.

(10) Patent No.: US 9,290,884 B2
(45) Date of Patent: Mar. 22, 2016

(54) DOSING APPARATUS AND METHOD FOR DOSING A COMPOSITION

(75) Inventors: Carol Stingl, Dusseldorf (DE); Gerold Carlhoff, Toenisvorst (DE); Heribert Lohwieser, Siegsdorf (DE); Andreas Ruppert, Siegsdorf (DE)

(73) Assignee: Ecolab USA Inc., St. Paul, MN (US)

( * ) Notice: Subject to any disclaimer, the term of this patent is extended or adjusted under 35 U.S.C. 154(b) by 552 days.

(21) Appl. No.: 13/700,554

(22) PCT Filed: Jun. 18, 2010

(86) PCT No.: PCT/EP2010/058600

§ 371 (c)(1),
(2), (4) Date: Nov. 28, 2012

(87) PCT Pub. No.: WO2011/157298

PCT Pub. Date: Dec. 22, 2011

(65) Prior Publication Data

US 2013/0074942 A1 Mar. 28, 2013

(51) Int. Cl.

| | |
|---|---|
| ***D06F 39/02*** | (2006.01) |
| ***A47L 15/44*** | (2006.01) |
| ***B01F 1/00*** | (2006.01) |

(52) U.S. Cl.

CPC ..... *D06F 39/02* (2013.01); *A47L 15/449* (2013.01); *A47L 15/4436* (2013.01); *B01F 1/0027* (2013.01); *B01F 1/0038* (2013.01); *D06F 39/022* (2013.01); *Y10T 137/0335* (2015.04); *Y10T 137/4891* (2015.04)

(58) Field of Classification Search

CPC ..... D06F 39/02
USPC ..... 137/4
See application file for complete search history.

(56) References Cited

U.S. PATENT DOCUMENTS

| | | | | |
|---|---|---|---|---|
| 4,020,865 | A | 5/1977 | Moffat et al. | |
| 5,137,694 | A * | 8/1992 | Copeland et al. | 422/106 |
| 2002/0147124 | A1 | 10/2002 | Klos et al. | |

FOREIGN PATENT DOCUMENTS

| | | |
|---|---|---|
| WO | WO2006/037354 | 4/2006 |
| WO | WO2008/077437 | 7/2008 |

*Primary Examiner* — Sean E Conley
(74) *Attorney, Agent, or Firm* — Merchant & Gould P.C.

(57) ABSTRACT

The invention refers to a dosing apparatus (1) for dosing a composition (31), comprising: at least one box (2) for keeping the composition (31) or a capsule (43) containing the composition (31), a solution reservoir (3) for preparing a composition solution (4) with a pre-defined concentration of the composition (31) in solution, wherein the composition solution (4) with said pre-defined concentration of the composition (31) in solution can be further used as a use solution (34), at least one spray means (5) coupled to the box (2) for bringing the composition (31) being in the box (2) into contact with a solvent liquid, such that an amount of the composition (31) dissolves and the thus resulting composition solution (4) flows into the solution reservoir (3), at least one spray line (10), for feeding the spray means (5) with the solvent liquid, a supply line (6) comprising a liquid connection (7), for supplying fresh liquid, preferably water, to the solution reservoir (3), measuring means (14) for measuring the conductivity of the composition solution (4), at least one motorized feed pump (15) for moving the composition solution (4), the solving liquid, the use solution (34), and/or the fresh liquid, and an electronic control unit (16) for controlling the operation of the dosing apparatus (1). The invention is especially specified in that, the dosing apparatus (1) additionally comprises: a day tank (39) for storing the use solution (34), such that the composition solution (4) with the pre-defined concentration of the composition (31) in solution can be prepared without changing the concentration of the composition (31) in solution in the use solution (34) stored within the day tank (39), a flushing out line (40), connecting the solution reservoir (3) with the day tank (39) for discharging the composition solution (4) with the pre-defined concentration of the composition (5) in solution from the solution reservoir (3) into the day tank (39), thereby refilling the day tank (39) with the use solution (34), a discharge line (8), which is connected to the day tank (39), comprising a discharge (9) for discharging the use solution (34) from the day tank (39). The invention further refers to a method for dosing a composition using said dosing apparatus (1).

22 Claims, 2 Drawing Sheets

DOSING APPARATUS AND METHOD FOR DOSING A COMPOSITION

The invention refers to a dosing apparatus for dosing a composition, comprising: At least one box for keeping the composition or a capsule containing the composition, the solution reservoir for preparing a composition solution with a pre-defined concentration of the composition in solution, wherein the composition solution with said pre-defined concentration of the composition in solution can be further used as a use solution, at least one spray means coupled to the box for bringing the composition being in the box into contact with a solvent liquid, such that an amount of the composition dissolves and the thus resulting composition solution flows into the solution reservoir, at least one spray line for feeding the spray means with the solvent liquid, a supply line comprising a liquid connection for supplying fresh liquid, preferably water, to the solution reservoir, measuring means for measuring the conductivity of the composition solution, at least one motorized feed pump for moving the composition solution, the solving liquid, the use solution, and/or the fresh liquid, and an electronic control unit for controlling the operation of the dosing apparatus. The invention further refers to a method for dosing a composition using said dosing apparatus.

Dosing apparatuses and methods are useful for bringing a composition into solution, for example, for cleaning purposes in a washing machine or the like. Compared to readily made cleaning liquids, the use of composition concentrates, for example solid or liquid detergent compositions, has the advantage of requiring less volume and weight with respect to storage and transportation capacities.

However, such compositions need to be brought into solution in order to use them, for example, in a cleaning process. Devices and methods for the generation of liquid detergent concentrates from detergent compositions are well known in the state of the art.

The US 2002/0147124 A1, for example, describes a device for generating a liquid detergent concentrate from a solid detergent, wherein the device includes a solid detergent reservoir for holding a solid detergent, a stock solution reservoir for holding a stock solution, and a hot-water heater for controlling the temperature of the water used to generate the stock solution from the solid detergent, by directing the hot-water against the exposed surface of a block of a solid detergent through a nozzle.

The U.S. Pat. No. 5,137,694 discloses a dosing apparatus which features a solution reservoir for retaining a composition solution, a chamber for retaining a solid composition, measuring means for measuring the concentration of the composition in solution, and a spray line for bringing the composition solution from the solution reservoir into contact with the solid composition, so as to dissolve a portion of the solid composition and increase the concentration of the composition solution. In order to achieve a liquid composition solution having a predetermined concentration, the dosing apparatus according to U.S. Pat. No. 5,173,694 provides a circulation of the composition solution which is dependent on a response signal from the concentration measuring means, so that the concentration of the composition in the composition solution does not fall below a pre-determined minimum. Said dosing apparatus also includes a measuring device for measuring the volume of the composition solution in the solution reservoir, such that when the volume of the composition solution is below a pre-determined minimum, fresh water is being added to the solution reservoir. The dosing apparatus also includes means for controlling the flow of the composition solution and for dispensing the composition solution from the solution reservoir to a use point.

A dosing apparatus and a method, such as described above, is disclosed in WO 2008/077437. In order to achieve a composition solution with a pre-defined concentration of the composition in solution, the disclosure according to WO 2008/077437 provides a circulation of the composition solution through the spray line, wherein the circulation depends on a response signal from the measuring means for measuring the conductivity of the composition solution. The concentration of the composition solution is being determined with respect to the measured conductivity of the composition solution. Fresh water is being added to the solution reservoir when the filling height of the composition solution is below a pre-determined minimum and/or when the composition solution is being discharged. A discharge line is connected to the solution reservoir, for discharging the composition solution with the pre-determined concentration of the composition solution from the solution reservoir to a use point.

Such dosing apparatuses and methods, however, have the disadvantage, that while preparing new amounts of composition solution with pre-defined concentration within the solution reservoir, the concentration of the composition in solution within the composition solution changes, since for refilling the solution reservoir, fresh liquid is being filled into the reservoir. Refilling can be done either after emptying the solution reservoir completely, after discharging specific amounts of the composition solution, or after certain periods of time. However, when preparing the composition solution with pre-defined concentration of the composition in solution, it will not be possible to discharge any composition solution with pre-defined concentration. Hence, for completely refilling the solution reservoir on the one hand, a considerable amount of waiting time is required, in which a composition solution with pre-defined concentration of the composition in solution can not be discharged. When refilling the solution reservoir at a higher frequency on the other hand, e.g. after certain periods of time, or always when a certain amount of composition solution is being discharged from the day tank, a precise documentation of the concentration of the composition solution is hardly possible and waiting times for preparing the composition solution are nonetheless required.

It is an object of the present invention to provide an improved dosing device for dosing a composition with respect to the automatic preparation and documentation of a pre-determined concentration of the composition in solution within a composition solution. A further object of the present invention is to provide a method for dosing a composition, which comprises the use of the dosing apparatus according to the present invention. Another object of the present invention is to provide a dosing apparatus, which fulfills the requirements of applications in the medical field, especially with respect to regulations and security measures.

DESCRIPTION OF THE INVENTION

The present invention solves the above mentioned problem by means of a dosing apparatus for dosing a composition, comprising: at least one box for keeping the composition or a capsule containing the composition, a solution reservoir for preparing a composition solution with a pre-defined concentration of the composition in solution, wherein the composition solution with said pre-defined concentration of the composition in solution can be further used as a use solution, at least one spray means coupled to the box for bringing the composition being in the box into contact with a solvent liquid, such that an amount of the composition dissolves and the thus resulting composition solution flows into the solution reservoir, at least one spray line, for feeding the spray means with the solvent liquid, a supply line comprising a liquid connection, for supplying fresh liquid, preferably water, to the solution reservoir, measuring means for measuring the conductivity of the composition solution, at least one motorized feed pump for moving the composition solution, the solving liquid, the use solution, and/or the fresh liquid, and an electronic control unit for controlling the operation of the dosing apparatus, wherein the dosing apparatus additionally comprises: a day tank for storing the use solution, such that the composition solution with the pre-defined concentration of the composition in solution can be prepared without changing the concentration of the composition in solution in the use solution stored within the day tank, a flushing out line, connecting the solution reservoir with the day tank for discharging the composition solution with the pre-defined concentration of the composition in solution from the solution reservoir into the day tank, thereby refilling the day tank with the use solution, a discharge line, which is connected to the day tank, comprising a discharge for discharging the use solution from the day tank.

Furthermore, the invention solves above mentioned problem by means of a method for dosing a composition, comprising the steps of: placing the composition or the capsule containing the composition into the box of the dosing apparatus according to the invention, preparing a composition solution with a pre-defined concentration of the composition in solution for use as a use solution, while essentially keeping the composition solution within the solution reservoir, flushing the composition solution with a pre-defined concentration of the composition in solution from the solution reservoir into the day tank, thereby refilling the day tank with said use solution and discharging at least a portion of the use solution from the day tank via the discharge line to one or several use points.

The advantage of the dosing apparatus and method according to present invention is given by the fact that the composition solution with pre-defined concentration of the composition in solution can be prepared without being required to change the concentration of the composition in solution within the use solution, which is stored within the day tank and may be discharged from the day tank to some use point.

Therefore, when discharging the use solution from the day tank, a new use solution can already be prepared simultaneously, without risking any change of the concentration of the composition solution within the day tank. At the time, when the day tank is being emptied, a new composition solution with pre-defined concentration of the composition in solution might then be already prepared within the solution reservoir, such that it only needs to be flushed through the flushing out line into the day tank. Hence, the time for refilling the day tank is minimized. The day tank may be refilled at the time when the day tank is being completely emptied, after discharging certain amounts of the use solution, or after specific time intervals.

Without any long waiting times for refilling the day tank, the dosing apparatus can also be designed in a much more compact way compared to previous dosing apparatuses, since the day tank and solution reservoir can be designed having a much smaller size.

Furthermore, when refilling the day tank with new use solution, e.g. after completely emptying it, the measured concentration of the composition solution concentration may be stored. Before the next refilling procedure of the day tank, no further change of the concentration is possible, since the day tank is generally separate from the composition being located in the box or any infeed of fresh liquid. Therefore, the stored value of the measured concentration provides an accurate value for the actual concentration of the use solution within the day tank. Documentation of the concentration of the delivered use solution will therefore be sufficient for even high standards, such as in medical applications.

A dosing apparatus according to the present invention can be used in hospitals, as for example in medical applications such as cleaning of medical devices, in which documentation is essential and a constant concentration of the composition solution is critical.

Within present application, the composition solution with the pre-defined concentration of the composition solution is called "use solution", after being transferred from the solution reservoir to the day tank.

"Composition" in the sense of present application means any composition, which can be either liquid or solid. A solid composition may include for example powders of formed blocks of the composition in any kind of shapes, preferably with little or no hollow spaces within the block. The composition may be also in the form of pastes or jells having any kind of viscosity.

Preferred embodiments of said dosing apparatus and said method have the subject matter of further dependent claims.

In a preferred embodiment of the dosing apparatus the spray line is configured to provide a liquid connection between the solution reservoir and the spray means, such that the solvent liquid for dissolving an amount of the composition is actually given by the composition solution itself. After being sprayed onto the composition, the resulting composition solution flows back into the solution reservoir, thereby realizing a circulation line for increasing the concentration of the composition solution. In such an embodiment of the dosing apparatus the concentration of the composition solution within the solution reservoir may be increased by operating the circulation line, which in other words means by feeding the spray means with composition solution and thereby bringing the composition solution into contact with the composition, which dissolves and flows back into the resolution reservoir. The concentration of the composition solution can be decreased by supplying fresh liquid, preferably water to the solution reservoir.

In another preferred embodiment of the dosing apparatus the measuring means for measuring the conductivity of the composition solution are comprised within the spray line. Placement of the measuring means within the spray line has the advantage that the measuring means are in contact with a feed of the composition solution rather than with stagnant solution. This avoids erroneous measurements which may occur due to local concentration differences in the stagnant composition solution kept in the solution reservoir. Furthermore, in an advantageous embodiment of the dosing apparatus the measuring means are in contact with the electronic control unit, so that it is possible to continuously calculate a mean value of the conductivity of the composition solution going through the spray line. Calculation of the mean value may, however, account for any expected change of the conductivity when operating the circulation line. The thus obtained mean value of conductivity is considered to represent more exactly the actual concentration of the composition solution compared to a conductivity value measured only at the local place within the solution reservoir. The electronic control unit may comprise for example a microcontroller or microprocessor for performing the calculation and a storage device for storing the corresponding data values.

In another preferred embodiment of the dosing apparatus, the dosing apparatus further comprises a temperature measuring device for normalizing the measured conductivity with respect to temperature, and wherein the temperature measuring device is comprised within the spray line. A temperature measuring device may be used for normalizing the measured electric conductivity with respect to temperature. In one preferred embodiment of the invention, the temperature measuring device is included within a sensor for measuring the electric conductivity of the fluid.

Furthermore, in a preferred embodiment of the dosing apparatus according to the invention, the dosing apparatus further comprises an additional motorized feed pump for moving the composition solution with pre-defined concentration of the composition in solution in the solution reservoir through the flushing out line into the day tank. Such an embodiment of the invention allows even better for preparing a composition solution with pre-defined concentration of the composition solution, without having an effect on the concentration of the composition solution in the day tank. The flushing out line, the spray line and discharge line may each utilize separate pumps for feeding the liquid through those lines. In such a way, it can be ensured, that during operation of the spray line or discharge line no spurious liquid will be transferred from the solution reservoir to the day tank, thereby possibly changing the concentration of the composition in solution within the day tank. The means used for moving the composition solution with pre-defined concentration of the composition solution from the solution reservoir through the flushing out line into the day tank are thereby completely separate from those means, that are used for preparing the composition solution, e.g. the spray line and a corresponding motorized pump.

In a particularly preferred embodiment of the invention the measuring means for measuring the conductivity of the composition solution are means for measuring the inductive conductivity of the composition solution. By comprising an inductive conductivity device for measuring the electric conductivity, the dosing apparatus is not affected by fouling of any surfaces that are exposed to the composition solution. The thus measured conductivity value is generally independent of any fouling of the sensor.

In another embodiment of the dosing apparatus the dosing apparatus further comprises means, preferably at least two level gauges within the day tank, for measuring the filling height of the use solution in the day tank. One level gauge may be an upper level gauge, whereas the other level gauge may be a lower level gauge. The level gauges measure the filling height of the use solution within the day tank and may send the information to the electronic control unit, which internally regulates the point at which the day tank is being refilled and also the amount of composition solution, so that the level within the day tank does not exceed a maximum level. While operating the dosing apparatus, the filling procedure of the day tank through the flushing out line may be terminated by the electronic control unit when the filling height of the composition solution within the day tank reaches the upper level gauges.

In another embodiment of the dosing apparatus, the dosing apparatus further comprises a funnel positioned in between the box and the solution reservoir. By spraying the solvent liquid unto the composition being in the box, an amount of the composition dissolves. In this embodiment, the funnel is configured to guide said resulting composition solution from the box into the solution reservoir. The funnel may have on its upper side dimensions, which are comparable to the size of the box or capsule containing the composition. Smaller dimensions may be advantageous, depending on the specific shape of the box, the location of the composition and/or capsule containing the composition and the spray means. Thereby, it can be ensured, that the composition solution flows from the box into the solution reservoir. The funnel may be oriented and placed in such a way that the composition solution is being guided from the box into the solution reservoir due to the gravitational pull.

In a further preferred embodiment of the dosing apparatus the supply line for supplying said fresh liquid, preferably water, to the solution reservoir further comprises an infeed, which is configured to stream said fresh liquid along the funnel. By streaming said fresh liquid along the funnel, the funnel is being cleaned from any composition solution that might have been stuck on the inner surface of the funnel. In this way, any blockage or sedimentation in the box may be prevented. Thereby, even better control of the concentration of the composition solution is ensured, especially when operating the dosing apparatus for longer time periods.

Furthermore, in a preferred embodiment of the dosing apparatus with infeed, the infeed for streaming said fresh liquid along the funnel is a fan nozzle, and the fan nozzle is configured to guide the stream of fresh liquid along the inner surface of the funnel, mostly perpendicular to the symmetric axis of the funnel for cleaning the inner surface of the funnel. By streaming the liquid along the inner surface of the funnel, mostly perpendicular to the symmetric axis of the funnel, the stream of fresh liquid might pass along the inner surface of the funnel in a spiral-shaped or helical path along the inner surface of the funnel, thereby wetting a considerable part of the inner surface of the funnel. In another embodiment, the fan nozzle might be configured to guide the stream of fresh liquid along the inner surface of the funnel in an angle, which in relation to the gravitational pull is being optimized for a maximum path along the inner surface of the funnel, the opening angle of the funnel, the shape of the fan nozzle, the pressure of the fresh liquid, and the exit velocity of the fresh liquid. Furthermore, the fan nozzle may be configured such, that two streams are being generated. One stream may be directed in one direction, whereas the other stream may be directed into the opposite direction and the liquid may exit the stream in a downward movement along the funnel in the direction of the gravitational pull. With respect to the gravitational pull, the streams are configured such, that they clean a considerable part of the surface of the funnel.

In an even further embodiment of the dosing apparatus, the day tank and the solution reservoir are essentially joint tanks with a partition wall for separating the interior volume of the solution reservoir from that of the day tank. In another embodiment of the dosing apparatus, the day tank and the solution reservoir are essentially separate tanks. In both embodiments, the tanks are configured to provide inlets and outlets for various operating elements, such as for example a spray line, supply line, measuring means for measuring the filling height within the tank, flushing out line, and discharge line. In case of separate tanks the day tank and the solution reservoir might only be connected with each other by the flushing out line. A separate day tank may be located close to the application in which the use solution is being used. Even multiple day tanks within one or different applications may be connected with the dosing apparatus. Every day tank might be connected to the solution reservoir with a flushing out line. Those multiple day tanks may be emptied at different times, so that refilling of one tank has no effect on the refilling procedure of any other tank.

To achieve the object mentioned in the introduction there is further provided a method for dosing a composition, comprising the steps of: placing the composition or the capsule containing the composition into the box of the dosing apparatus according to any of the previous embodiments; preparing a composition solution with a pre-defined concentration of the composition solution for use as a use solution, while essentially keeping the composition solution within the solution reservoir; flushing the composition solution with a pre-defined concentration of the composition solution from the solution reservoir into the day tank, thereby refilling the day tank with said use solution; and discharging at least a portion of the use solution from the day tank via the discharge line to one or several use points. By use of the dosing apparatus according to the previously described embodiments the steps of discharging at least a portion of the use solution from the day tank via the discharge line to one or several use points and the step of preparing a composition solution with a pre-defined concentration of the concentration of the composition solution for use as a use solution may be performed simultaneously or at least partially at the same time. The step of discharging the use solution at least partially from the day tank may be followed by flushing the composition solution with a pre-defined concentration of the composition solution from the solution reservoir into the day tank. The steps of preparing, flushing, and discharging may be performed repeatedly.

In an alternative of the method according to the invention, the step of preparing a composition solution with a pre-defined concentration of the composition solution for use as a use solution further comprises: i) adding an amount of fresh liquid via the supply line to the solution reservoir; ii) spraying the composition solution taken from the solution reservoir via the spray line onto the composition such that an amount of the composition dissolves and the thus resulting composition solution flows back into the solution reservoir; iii) measuring the conductivity of the composition solution with the measuring means and determining the concentration of the composition solution in relation to the measured conductivity; wherein the steps i)-iii) and/or the steps ii)-iii) are repeatedly performed either consecutively or simultaneously for a predetermined time and/or until a predetermined amount of the composition solution with a predetermined concentration of the composition in solution is reached.

According to a further alternative of the method according to the invention the previously described alternative may further comprise the step of storing the measured conductivity of the composition solution just before, during, or just after the step of flushing the composition solution from the solution reservoir into the day tank. By storing the measured conductivity of the composition solution just before, during, or just after the step of flushing, the concentration of the use solution can be documented for consecutive batches of the use solution, that are discharged from the day tank. While flushing the composition solution through the flushing out line, no liquid should be fed through the spray line or the supply line, since that might change the concentration of the composition solution within the solution reservoir. Measuring the conductivity of the composition solution may then be performed after feeding liquid through the spray line is being stopped. When no fresh liquid is being added to the solution reservoir, the measurement can be performed before, during, or after the flushing of the composition solution through the flushing out line, since feeding liquid through the flushing out line will not change the concentration of the composition solution within the spray line. Preferably, however, the measurement is performed before flushing the composition solution through the flushing out line, since the spray line might be emptied when completely flushing the composition solution from the solution reservoir into the day tank.

According to another alternative of the method according to the invention, the step of measuring the conductivity is performed after the step of adding fresh liquid into the solution reservoir, but before the step of spraying the composition solution onto the composition, wherein the method further comprises a step of saving the thus measured conductivity as reference value and wherein at least one further step of measuring the conductivities is performed after the step of spraying the composition solution onto the composition, wherein the method further comprises a step of comparing the measured conductivity with said reference value and a step of signalizing malfunction of the water supply when the step of comparing the measured conductivity with said reference value indicates, that the conductivity stays approximately constant.

The latter alternative of the method provides an additional protection against possible concentration variations of the use solution, which may be caused due to malfunction of the water supply. In case of a correct working water supply, the concentration of the composition in solution will drop significantly when fresh water is being added into the solution reservoir, since the composition solution within the solution reservoir is being diluted by the fresh liquid. However, in case of a malfunction of the water supply, the concentration within the spray line will not decrease when starting to feed the composition solution from the solution reservoir through the spray line. After starting to feed the composition solution through the spray line, a significant drop in the measured concentration is expected. However, at some later time, the concentration will rise again, since the composition solution is getting into contact with the composition located within the box through the spray means.

Other object, features and advantages of the present invention will appear from the following detailed disclosure of the preferred embodiment, from enclosed patent claims as well as from the accompanying drawings.

BRIEF DESCRIPTION OF THE DRAWINGS

A preferred embodiment of the present invention will now be described in greater detail below with reference to the accompanying drawing, in which.

DETAILED DESCRIPTION OF A PREFERRED EMBODIMENT

Figure 1:
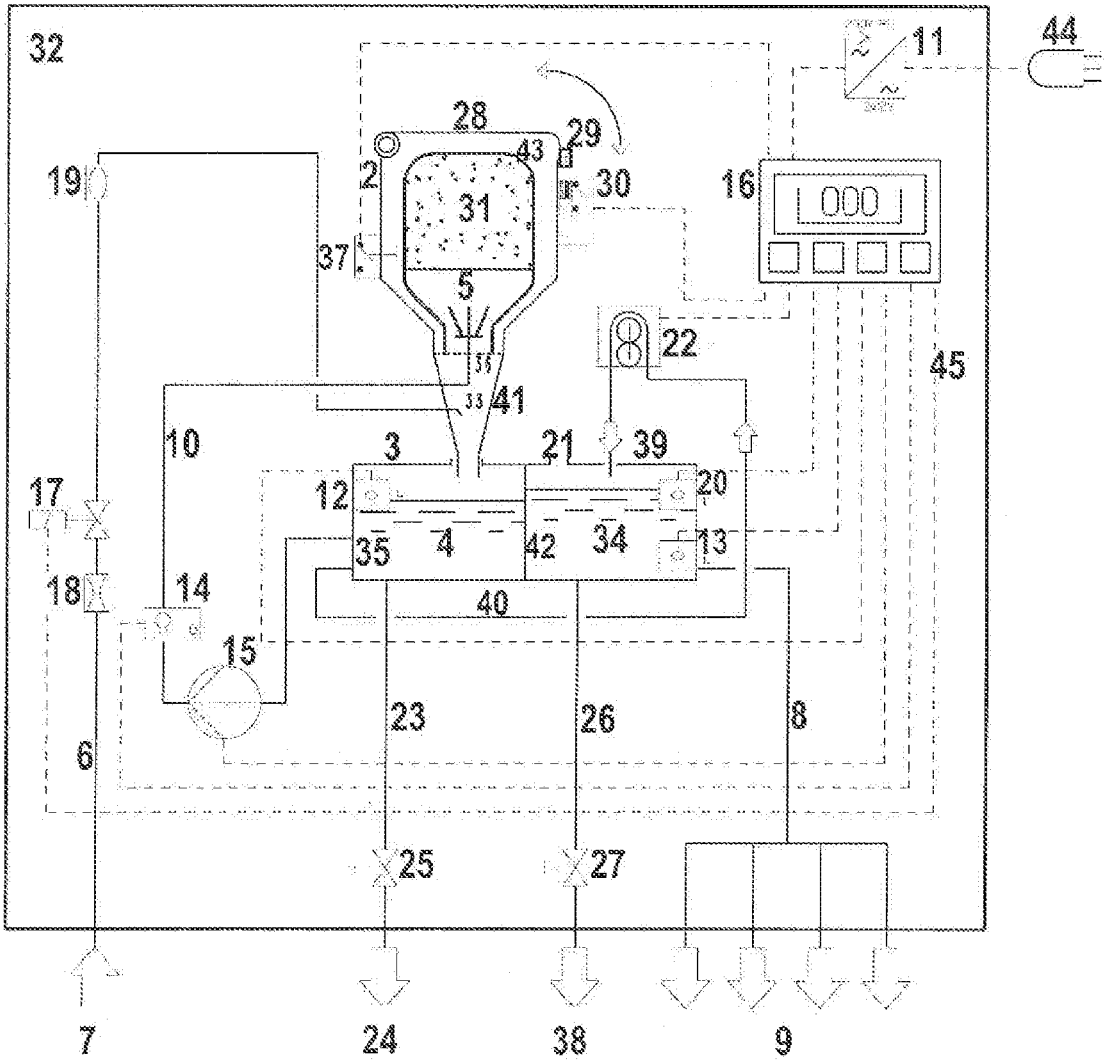
FIG. 1 shows schematically a dosing apparatus according to an embodiment of the present invention.

In FIG. 1, a dosing apparatus 1 for dosing a composition 31 according to a preferred embodiment is shown schematically. The dosing of the composition 31 is performed with the dosing apparatus 1, by preparing a composition solution 4 with pre-defined concentration of the composition 31 in solution, which is then provided to a discharge 9 as a use solution 34. FIG. 1 indicates a mounting plate 32 on which most of the devices of the dosing apparatus 1 are mounted. The dosing apparatus 1 is connected to a liquid connection 7 and solenoid valve 17 for feeding fresh liquid, preferably water, into the dosing apparatus 1, a drain connection 24 and 38, the discharge 9, and an electric power supply connection 44.

The dosing apparatus comprises a box 2 for keeping the composition 31 or a capsule 43 containing the composition 31, a solution reservoir 3, for preparing the composition solution 4, a day tank 39 for storing the use solution 34, and an electronic control unit 16, wherein all these devices are connected to each other with various connection and operating means, such as for example pumps, feed lines, a discharge line 8, electrical connections 45 and flow control elements, etc. The mentioned devices and means will be described in more detail below.

Within the dosing apparatus, a supply line 6 is leading from the liquid connection 7 to an infeed point 33 located at or in a funnel 41, which connects the box 2 with the solution reservoir 3. Fresh liquid, preferably water, is being added via the supply line 6 into the solution reservoir 3 for filling the solution reservoir 3 with liquid. The liquid feed is controlled by a flow control element 17, for example a solenoid valve, which is electronically controlled by the electronic control unit 16. The electronic control unit 16 is connected with a power supply unit 11, which is provided with energy through the electrical power supply connection 44. The supply line 6 further comprises a backflow preventer 19 and a flow regulator 18. The backflow preventer 19 prevents any flow of liquid backwards from the solution reservoir 3 towards the liquid connection 7. This is a safety mechanism to keep the composition solution 4 out of the original liquid supply. The solenoid valve 17 of the fresh water infeed stops, when an upper level gauge 12 within the solution reservoir 3 passes the information, that a certain level is reached, to the electronic control unit 16.

For increasing the concentration of the composition 31 in solution, the dosing apparatus 1 comprises a spray line 10, with spray means 5, which are located in the box 2, and a motorized feed pump 15. The spray line 10 is connected to a sump 35 of the solution reservoir 3 for feeding the spray means 5 with the composition solution 4, such that the composition 31 comes into contact with the composition solution 4, dissolves and the thus resulting composition solution flows back into the solution reservoir 3.

The box 2 has an opening closable with a lid 28, the lid having a magnet 29. Further, a magnetic switch 30 and a capsule switch 37 is under control of the electronic control unit 16. The capsule switch 37 may detect if a capsule 34 is present within the box 2 and may provide that information to the electronic control unit 16. For example the spray line 10 for increasing the concentration of the composition solution 4 may only be operated, if the capsule switch 37 detects a capsule 34, including the composition. As shown in FIG. 1, the side walls of the box 2 may partially have the shape of a funnel with an opening at its bottom, wherein the opening includes a colander 36. The colander 36 is to prevent the composition 31 or other objects from falling into the solution reservoir 3. Throughout this text, with "bottom" of the box 2 or any other device, that side is meant, to which the composition solution or any other liquid is drawn by the gravitational pull when the dosing apparatus is set up upright. The funnel 41, that comprises the infeed point 33, is located below the opening at the bottom of the box 2 in between the box 2 and the solution reservoir 3. The funnel 41 thereby provides a liquid connection between the box 2 and the solution reservoir 3. The funnel 41 has a first diameter, which is large enough to collect most of the composition solution, which is sprayed into the box 2, and a second diameter for guiding the composition solution into a respective opening in the solution reservoir 3. A fan nozzle, which is not shown in the Figure may guide the fresh liquid fed through the infeed 33 along the funnel 41, in order to clean the interior surface of the funnel 41, such that no composition solution may remain.

The solution reservoir 3 for preparing the composition solution 4 with pre-defined concentration collects the composition solution 4. The dosing apparatus 1 comprises an upper level gauge 12, which is located at the solution reservoir 3 and which is electrically connected to the electronic control unit 16. The level gauge 12 is intended to provide the electronic control unit 16 with information about the filling height of the composition solution 4 within the solution reservoir 3 so that the electronic control unit 16 can control the operation of, for example, the solenoid valve 17 of the supply line 6.

The spray line 10 further comprises measuring means 14 which are electrically connected to the electronic control unit 16. The measuring means 14 are to measure the conductivity of the composition solution being fed through the spray line 10 and are to provide the electronic control unit 16 with the measured data so that the electronic control unit 16 can control the operation of the dosing apparatus. Preferably, the measuring means 14 may continually measure the conductivity of the solution. The measuring means may be configured such, that they measure the inductive conductivity of the composition solution 4. The electronic control unit 16 may calculate a corresponding concentration of the composition solution 4. When the concentration of the composition solution 4 reaches a certain threshold value, the electronic control unit 16 may stop the operation of the motorized feed pump 15 until additional fresh liquid is being added into the solution reservoir 3. When the spray line 10 is operated and the nominal concentration is not reached within an adjustable maximum proportioning time, the spraying process may stop and, upon expiry of a pre-defined time interval, an alarm may be triggered.

The dosing apparatus furthermore comprises a day tank 39, into which the composition solution 4 is being flushed, when the composition solution 4 has a pre-defined concentration of the composition 31 in solution. The day tank 39 is therewith refilled with use solution 34, which may be discharged to a use point.

As shown in FIG. 1, the day tank 39 and the solution reservoir 3 are essentially joint tanks, which are separated from each other by a partition wall 42. Both tanks, the day tank 39 and the solution reservoir 3 are fluidly connected by a flushing out line 40, for feeding the composition solution 4 into the day tank 39. The flushing out line 40 comprises a peristaltic pump 22, which is connected and controlled by the electronic control unit 16. The flushing out line 40 is connected with the sump 35 of the solution reservoir 3. The day tank 39 comprises a ventilation 21 for compensation of the pressure within the day tank 39.

The dosing apparatus 1, as shown in FIG. 1, also comprises an upper level gauge 20 and a lower level gauge 13 which are located in the day tank 39 and which are both electrically connected to the electronic control unit 16. The level gauges 20 and 13 are intended to provide the electronic control unit 16 with information about the filling height of the use solution 34 within the day tank 39 so that the electronic control unit 16 can control the operation of, for example, the peristaltic pump 22 of the flushing out line 40. If the nominal concentration in the solution reservoir 3 falls within a certain pre-defined interval of values, the day tank may be filled. To ensure that the solution reservoir 3 is not completely emptied, a maximum day tank refilling time may limit the refilling process.

Finally, the dosing apparatus 1 comprises a first drain line 23 and a second drain line 26. The first drain line 23 leads from the solution reservoir 3 to a drain connection 24, and the second drain line 26 leads from the day tank 39 to a drain connection 38. Both drain lines 23 and 26 comprise a drain tap 25, 27. The drain lines 23 and 26 are normally closed but can be opened for service purposes or the like when all the solution has to be drained off from the day tank 39 or solution reservoir 3 without being dependent on electricity or a correctly operating dosing apparatus.

Figure 2:
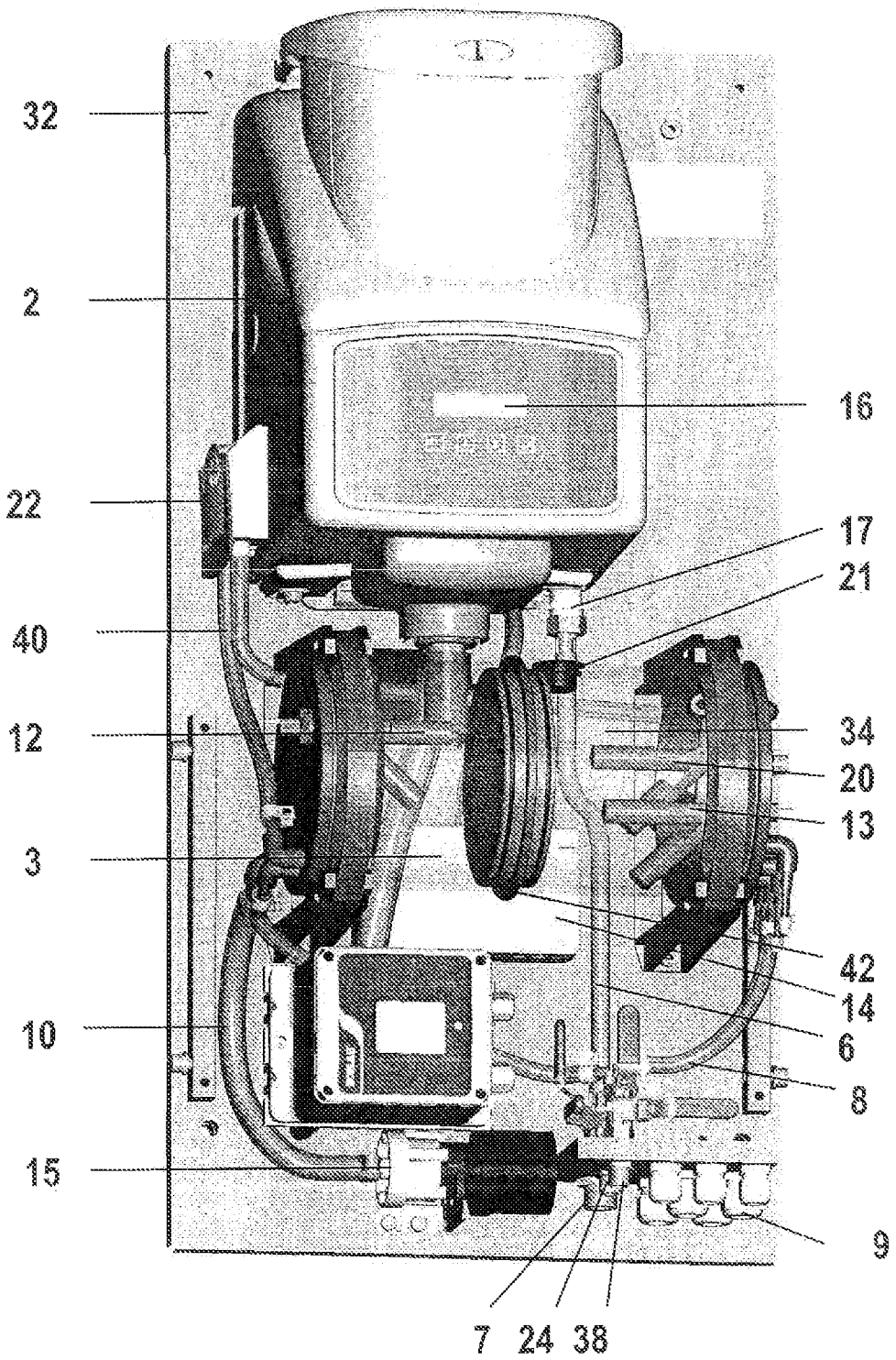
FIG. 2 shows a perspective view of the dosing apparatus according to the embodiment.

FIG. 2 shows a perspective view of the dosing apparatus 1 according to the previously described preferred embodiment. The box 2 and the electronic control unit 16 are jointly mounted to the mounting plate 32. The Figure also shows the solution reservoir 3 and day tank 39, which are formed as a cylindrical hollow tube with closed ends mounted to the mounting plate 32. A partition wall 42 separates the inner volume of the solution reservoir 3 from that of the day tank 39. The hollow tube of both tanks is transparent, such that the upper level gauge 12 and the ventilation 21, the day tank level gauge 20, as well as the lower level gauge 13 are visible and can be located within the solution reservoir 3 and day tank 39, respectively. Furthermore, the Figure shows the measuring means 14 and connection means, including the liquid connection 7 and the solenoid valve 17 for fresh water supply, the drain connection 24, the drain connection 38, and the discharge 9, being connected to the mounting plate 32, as well. All these devices are connected with each other, as already described before, via the spray line 10, supply line 6, discharge line 8, and flushing out line 40, including the peristaltic pump 22, the motorized feed pump 15, and measuring means 14, which are also clearly visible in FIG. 2.

LIST OF REFERENCE SIGNS

1 dosing apparatus
2 box
3 solution reservoir
4 composition solution
5 spray means
6 supply line
7 liquid connection
8 discharge line
9 discharge
10 spray line
11 power supply unit
12 upper level gauge
13 lower level gauge
14 measuring means
15 motorized feed pump
16 electronic control unit
17 solenoid valve for fresh water supply
18 flow regulator
19 backflow preventer
20 daytank level gauge
21 ventilation
22 peristaltic pump
23 drain line for solution reservoir
24 drain connection
25 drain tap
26 drain line for daytank
27 drain tap
28 lid of the box
29 magnet of the lid
30 magnetic switch
31 composition
32 mounting plate
33 infeed point
34 use solution
35 sump of the solution reservoir
36 colander of the box
37 capsule switch
38 drain connection for daytank
39 day tank
40 flushing out line
41 funnel
42 partition wall
43 capsule for the composition 31
44 electrical power supply connection
45 electrical and/or electronic signal lines

The invention claimed is:

1. A dosing apparatus for dosing a composition, comprising:

a) at least one container for containing the composition,
b) a solution reservoir for preparing a solution with a pre-defined use-concentration of the composition in solution to be further used as a use solution,
c) at least one spray means coupled to the container for bringing the composition into contact with a solvent liquid, such that an amount of the composition dissolves and the dissolved composition flows into the solution reservoir along a flow path,
d) at least one spray line for feeding the spray means with the solvent liquid,
e) a supply line comprising a liquid connection and a solenoid valve for supplying an unused solvent to the solution reservoir,
f) a measuring device for measuring conductivity of the solution,
g) at least one motorized feed pump for pumping the solution, the solvent liquid, the use solution, and/or the unused solvent,
h) an electronic control unit for controlling the operation of the dosing apparatus,
i) a tank for storing the use solution,
j) a transfer line connecting the solution reservoir with the tank and constructed for transferring the solution with the pre-defined use-concentration from the solution reservoir into the tank, and
k) a discharge line connected to the tank, comprising an outlet for discharging the use solution from the tank.

2. The dosing apparatus according to claim 1, wherein the spray line is configured to provide a liquid connection between the solution reservoir and the spray means (5).

3. The dosing apparatus according to claim 1, wherein the measuring device for measuring the conductivity of the solution is comprised within the spray line.

4. The dosing apparatus according to claim 1, wherein the dosing apparatus further comprises a temperature measuring device for normalizing the measured conductivity with respect to temperature, and wherein the temperature measuring device is comprised within the spray line.

5. The dosing apparatus according to claim 1 further comprising an additional motorized feed pump for pumping the solution from the solution reservoir through the transfer line into the tank.

6. The dosing apparatus according to claim 1, wherein the measuring device for measuring the conductivity is adapted for measuring inductive conductivity.

7. The dosing apparatus according to claim 1 further comprising means for measuring the filling height of the use solution in the tank.

8. The dosing apparatus according to claim 1, wherein the flow path comprises a funnel positioned between the container and the solution reservoir, wherein the funnel is configured to guide the dissolved composition from the container into the solution reservoir.

9. The dosing apparatus according to claim 8, wherein the supply line for supplying unused solvent to the solution reservoir further comprises an infeed configured to stream said unused solvent along an inner surface of the funnel.

10. The dosing apparatus according to claim 9, wherein the infeed is a fan nozzle configured to guide the stream of unused solvent substantially perpendicular to a symmetric axis of the funnel for cleaning the inner surface of the funnel.

11. The dosing apparatus according to claim 1, wherein the tank and the solution reservoir are joint tanks with a partition wall for separating an interior volume of the solution reservoir from that of the tank.

12. A method for dosing a composition, comprising:

a) placing the composition or the capsule containing the composition into the container of the dosing apparatus according to claim 1, b) preparing a solution with a pre-defined use-concentration of the composition in solution for use as a use solution, while essentially keeping the solution within the solution reservoir, c) flushing the solution with a pre-defined use-concentration from the solution reservoir into the tank, thereby refilling the tank with said use solution and d) discharging at least a portion of the use solution from the tank via the discharge line to one or several use points.

13. The method according to claim 12, wherein the preparing a solution with a pre-defined use-concentration further comprises I. adding an amount of unused solvent via the supply line to the solution reservoir, II. spraying the solution taken from the solution reservoir via the spray line onto the composition such that an amount of the composition dissolves and the dissolved composition flows back into the solution reservoir, III. measuring the conductivity of the solution with the measuring device and IV. determining a concentration of the composition in the solution.

14. The method according to claim 13 further comprising storing the measured conductivity of the solution just before, during, or just after the step of flushing the solution from the solution reservoir into the tank.

15. The method according to claim 13, wherein the measuring the conductivity is performed after adding unused solvent into the solution reservoir but before spraying the solution onto the composition, wherein the method further comprises saving the thus measured conductivity as a reference value, wherein at least one further measuring of the conductivity is performed during or after spraying the solution onto the composition, comparing the measured conductivity with said reference value, and signalizing malfunction of the water supply when the comparing the measured conductivity with said reference value indicates that the conductivity stays approximately constant.

16. The dosing apparatus according to claim 1, wherein the tank and the solution reservoir are separate tanks.

17. The dosing apparatus of claim 7, wherein the means for measuring the filling height comprises at least two level gauges within the tank.

18. The dosing apparatus of claim 1, wherein the solution reservoir and the tank are configured so that the solution can be prepared with the pre-defined use-concentration without affecting the concentration of the use solution stored within the tank.

19. A method for dispensing a use solution of a composition, the method comprising:

a) dispensing solution from a solution reservoir onto a concentrate comprising the composition to dissolve an amount of the composition;

b) flowing the dissolved composition and adding solvent into the solution reservoir, thereby resulting in a concentration of the composition;

c) measuring conductivity of the solution to determine the concentration of the composition;

d) when the concentration has reached a pre-determined use-concentration, transferring the solution into a tank; and e) dispensing the solution with the pre-determined use-concentration from the tank.

20. The method of claim 19, wherein steps a)-c) are performed simultaneously with step e).

21. A dispensing apparatus comprising:

a) a tank for storing a use solution;

b) a dispenser for dispensing the use solution from the tank;

c) a preparation system for preparing the use solution, the preparation system comprising:

i) a solution reservoir constructed to store solution and in fluid connection with the tank by a transfer line;

ii) a solvent supply line in fluid connection with the solution reservoir;

iii) a container for containing a composition concentrate;

iv) a solution supply line from the solution reservoir to the container coupled with a spray nozzle configured to spray the solution onto the composition concentrate;

v) a fluid path from the container to the solution reservoir; and vi) a measuring device for measuring conductivity of the solution, d) one or more pumps independently connected to one or more of the dispenser, the transfer line, and the solvent supply and solution supply lines; and e) a control unit adapted for controlling the dispensing apparatus.

22. The dispending apparatus of claim 21 further comprising a second solvent supply line in fluid communication with the fluid path and configured to flush the fluid path with solvent.

* * * * *